US006460477B1

(12) United States Patent
Hamilton et al.

(10) Patent No.: US 6,460,477 B1
(45) Date of Patent: Oct. 8, 2002

(54) SPONSON AND RIGID INFLATABLE BOAT INCORPORATING THE SAME

(75) Inventors: Bruce A. Hamilton, Arcata; Michael Kroemer, Eureka; Daniel B. Johnson, Arcata, all of CA (US)

(73) Assignee: Wing Inflatables, Arcata, CA (US)

( * ) Notice: Subject to any disclaimer, the term of this patent is extended or adjusted under 35 U.S.C. 154(b) by 0 days.

(21) Appl. No.: 09/676,191

(22) Filed: Sep. 28, 2000

(51) Int. Cl.[7] ..... B63B 7/08
(52) U.S. Cl. ..... 114/345; 114/360
(58) Field of Search ..... 114/345, 360, 114/283, 68, 69; 441/40, 66

(56) References Cited

U.S. PATENT DOCUMENTS 3,261,038 A * 7/1966 Klepper
3,611,459 A 10/1971 Sear et al.
4,779,555 A 10/1988 Hong
4,802,435 A * 2/1989 Choi ..... 114/360
5,215,031 A 6/1993 Inman et al.
5,518,431 A 5/1996 Staley
5,651,328 A 7/1997 Elkington
6,006,690 A 12/1999 Roy
6,024,042 A 2/2000 Eilert

* cited by examiner

*Primary Examiner*—Sherman Basinger
(74) *Attorney, Agent, or Firm*—Kolisch Hartwell PC

(57) ABSTRACT

An improved sponson and rigid inflatable boats incorporating the same. The sponson includes a non-inflatable buoyant component, such as closed-cell polyethylene, and an inflatable buoyant component, such as one or more inflatable tubes. The boat includes a rigid hull having sidewalls along which one or more of the improved sponsons extend. In some embodiments, the inflatable component is removably secured to the non-inflatable component by a restraining structure. In some embodiments, the restraining structure includes straps. In some embodiments, the restraining structure includes resilient arms that bias the inflatable component within a pocket formed in the non-inflatable component.

32 Claims, 4 Drawing Sheets

SPONSON AND RIGID INFLATABLE BOAT INCORPORATING THE SAME

FIELD OF THE INVENTION

The present invention relates generally to rigid inflatable boats, and more particularly to an improved sponson and rigid inflatable boats incorporating the same.

BACKGROUND OF THE INVENTION

Rigid inflatable boats, or RIBs, have rigid hulls and buoyant tubes, or sponsons, which extend along at least the sidewalls of the hulls to provide buoyancy thereto. Typically, the sponsons are inflatable tubes, such as are commonly used on inflatable boats used for rafting. An example of a known RIB is shown in FIG. 1 and generally indicated at 10. As shown, RIB 10 has a rigid hull 12 and one or more buoyant air-filled tubes 14 extending along the sidewalls 16 of the hull. At the rear of the RIB, a transom 18 extends between tubes 14. Examples of known RIBs with air-filled buoyant tubes are disclosed in U.S. Pat. Nos. 4,779,555, 5,651,328, 6,006,690, and 6,024,042, the disclosures of which are hereby incorporated by reference.

Other RIBs include foam-filled sponsons, or combinations of air- and foam-filled sponsons. For example, see U.S. Pat. No. 3,611,459, the disclosure of which is hereby incorporated by reference. Still a further example of known RIBs has an inflatable tube removably secured to the hull by a hook-and-loop fastener, and a foamed portion that extends from the hull and around the tube. The tube is secured to the hull by the hook-and-loop fastener, and the foamed portion is secured proximate the hull by a cover or sheath that extends from the hull and around the foamed portion.

SUMMARY OF THE INVENTION

The present invention is directed to an improved sponson and rigid inflatable boats incorporating the same. The sponson includes a non-inflatable buoyant component, such as closed-cell polyethylene, and an inflatable buoyant component, such as one or more inflatable tubes. The boat includes a rigid hull having sidewalls along which one or more of the improved sponsons extend. In some embodiments, the inflatable component is removably secured to the non-inflatable component by a restraining structure. In some embodiments, the restraining structure includes straps. In some embodiments, the restraining structure includes resilient arms that bias the inflatable component within a pocket formed in the non-inflatable component.

DETAILED DESCRIPTION AND BEST MODE OF THE INVENTION

Figure 1:
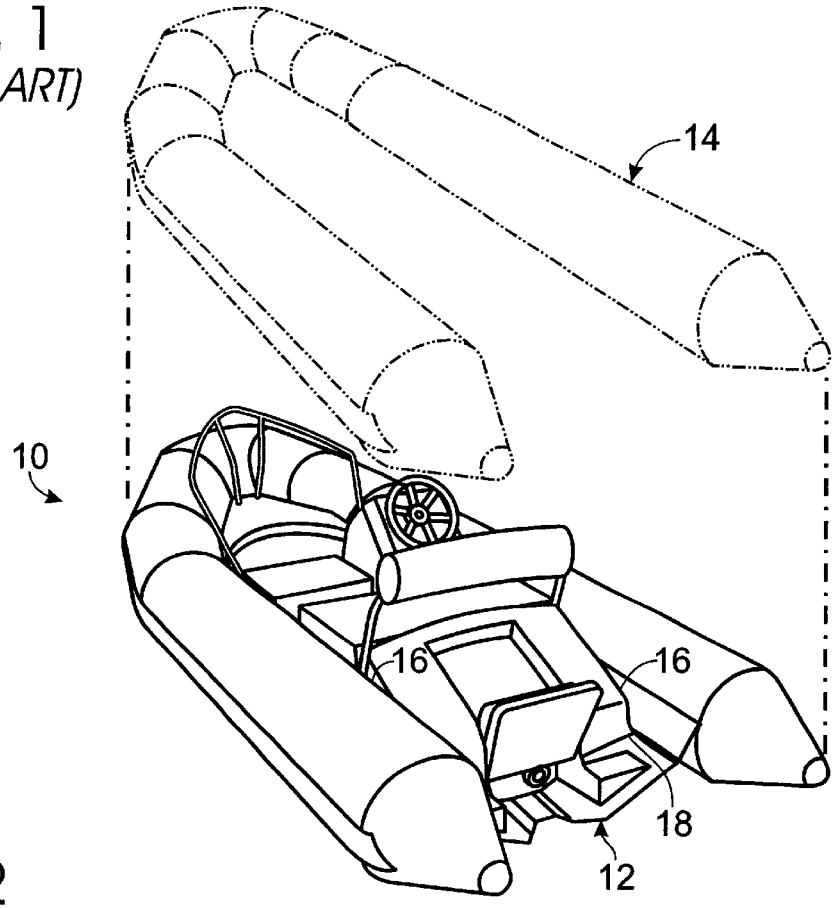
Fig. 1 (PRIOR ART)
FIG. 1 is an isometric view of a known rigid inflatable boat.
Figure 2:
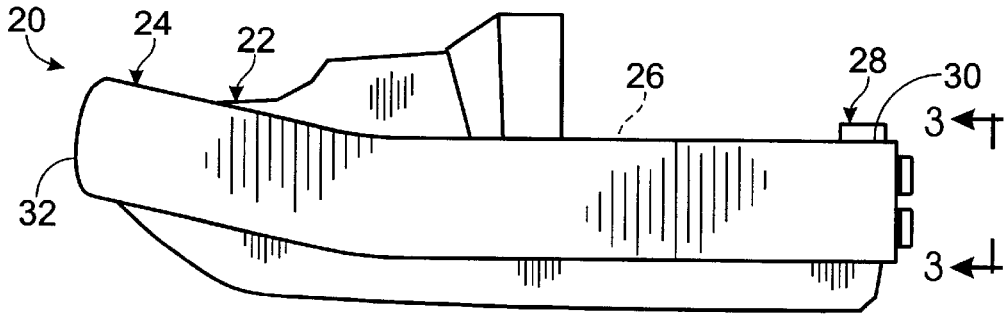
FIG. 2 is a side elevation view of a rigid inflatable boat having a sponson constructed according to the present invention.
Figure 3:
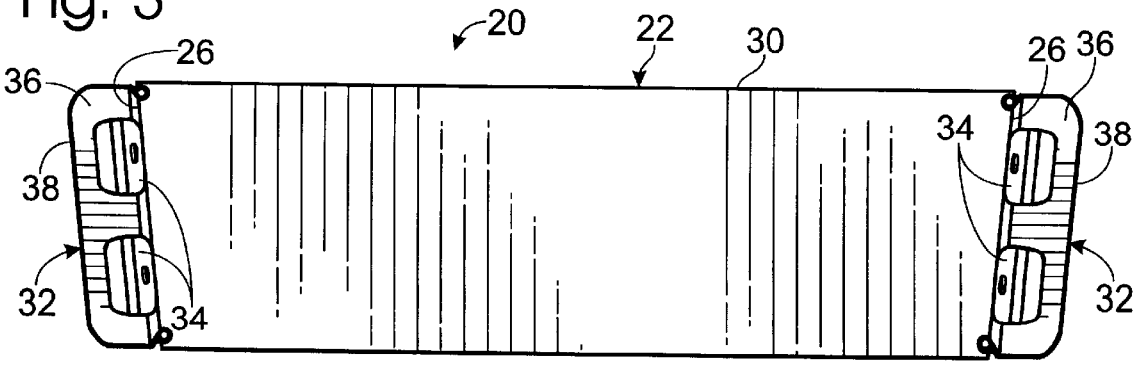
FIG. 3 is a partially schematic rear elevation view of the rigid inflatable boat of FIG. 2.

A rigid inflatable boat constructed according to the present invention is shown in FIGS. 2 and 3 and generally indicated at 20. As shown, boat 20 has a hull 22, bow region 24, sidewalls 26, aft region 28, and transom 30. Boat 20 typically will be motorized, either with an inboard or outboard motor or a plurality of motors (not shown). Hull 22 provides strength and stability to the boat, especially in rougher waters and when traveling at relatively high speeds.

Boat 20 is referred to as a rigid inflatable boat, or RIB, because at least the aft region of hull 22 is formed from a rigid material or materials that give that region a defined shape and increased strength compared to canvas, plastic and other sheet-like, flexible materials. Typically, the entire hull will be formed of a rigid material or materials. It is within the scope of the present invention that the entire hull may be formed from a rigid material, or that only the rear portion of the hull is formed from such a material. Examples of suitable hull materials include metal, such as aluminum, resins, such as fiberglass, and combinations thereof. It should be understood that the shape and size of hull 22 may vary from the illustrative example shown in FIG. 2 and the schematic representation shown in FIG. 3. Illustrative examples of other hull shapes and configurations are disclosed in the above-incorporated U.S. Pat. Nos. 4,779,555, 5,651,328, 6,006,690, and 6,024,042.

In addition to rigid hull 22, RIB 20 also includes one or more sponsons 32 that provide buoyancy to the hull. As discussed in more detail herein, sponsons 32 include an inflatable buoyant component 34 and a non-inflatable buoyant component 36. As shown in FIG. 3, the sponsons include a cover, or sheath, 38 that secures the buoyant components to hull 22. Sheath 38 may be formed from any suitable protective material. Examples of suitable materials include PVC, hypalon, neoprene and polyurethane. Another suitable material is fabric having a nylon substrate and a polyurethane coating. Sheath 38 may be secured to hull 20 via any suitable mounting mechanism. Typically, the sheath is secured with a mounting mechanism that allows the sheath to be selectively removed and replaced, such as for cleaning, repair or replacement.

Figure 4:
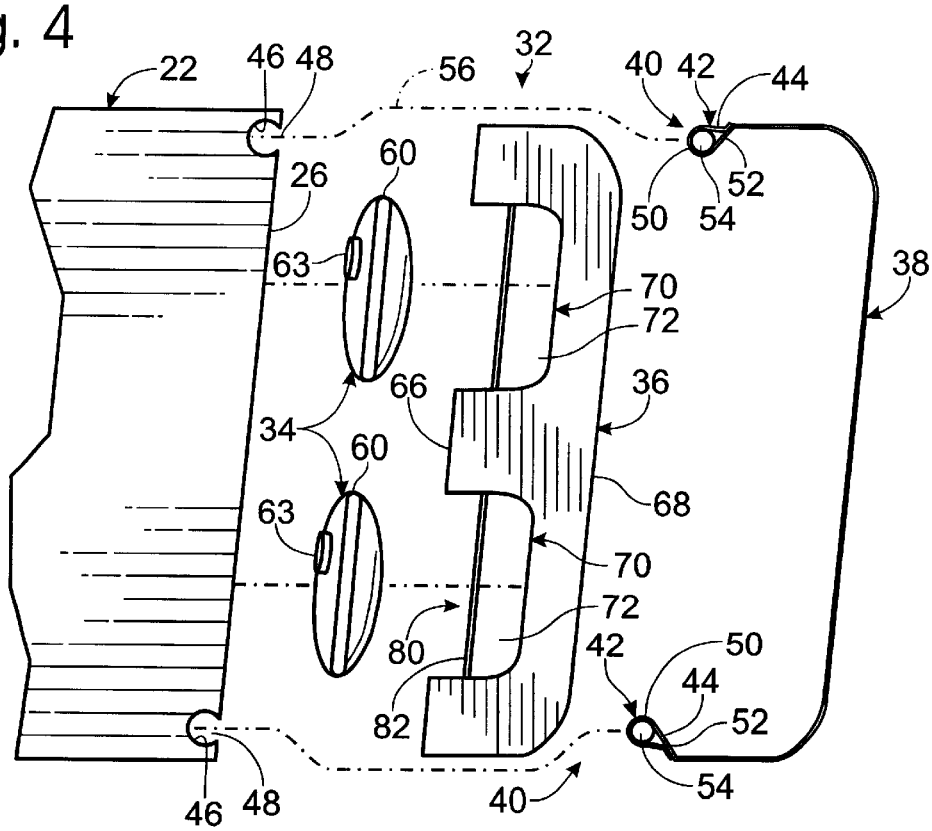
FIG. 4 is an exploded end view of a sponson constructed according to the present invention.

In FIG. 4, an example of a suitable mounting mechanism is shown in more detail at 40. Mechanism 40 includes anchors 42 on the ends or end regions 44 of sheath 38, and corresponding tracks 46 on hull 22. As shown, tracks 46 include a neck portion 48 of reduced thickness compared to the rest of the track. Anchors are adapted to be engaged by and selectively retained in the tracks. As shown, anchors 42 include a region of increased thickness 50, which may also be referred to as a head that is thicker than neck portion 48. The anchors further include a corresponding region 52, such as the portion of the sheath adjacent head 50, that is thinner than the neck region and therefore can pass through the neck region. Anchors 42 are slidably received within corresponding tracks 46 to secure the sheath to the hull. Typically, the anchors are inserted into the tracks from an end of the hull.

Anchors 42 may be formed of any suitable structure adapted to be received and selectively retained in tracks 46. An illustrative example of a suitable structure is shown in FIG. 4, in which anchor 42 includes a cable 54 around which sheath 38 extends. Cable 54 may be formed of rope, wire, plastic, or any other suitable material. Another suitable structure for region 50 is overlapping layers of the material used to form sheath 38. As also shown in FIG. 4, hull 22 and sheath 38 define a closed boundary 56 along their cross-sectional length, into which sponson 32 is received. Another example of a suitable mounting mechanism is lacings that extend through eyelets in the sheath, eyelets in the hull, or both, to secure the sheath to the hull. Still another example is hooks that extend from the hull to engage the non-inflatable component, extend from the hull to engage eyelets or other receivers on the sheath, or extend from the sheath to engage eyelets or other suitable receivers on the hull.

In FIG. 4, the construction of sponson 32 may be seen in more detail. As discussed, sponson 32 includes an inflatable buoyant component 34 and a non-inflatable buoyant component 36 to which the inflatable buoyant component is secured. Preferably, the inflatable component may be selectively removed from and replaced into securement with the non-inflatable component.

By "inflatable buoyant component," it is meant that a volume of gas, such as air, may be added to the component, which is adapted to selectively store the volume of gas in an interior chamber, typically formed of an expandable material. Gas may be added or removed from this chamber by a user via a valve or other suitable mechanism, with the volume of the chamber typically changing responsive to changes in the volume of gas stored within the chamber. The term "inflatable buoyant component" is meant to include, without being limited to, inflatable bladders and tubes and similar devices that selectively store a volume of gas in an interior chamber from which the gas may be added or removed through a valve.

Figure 5:
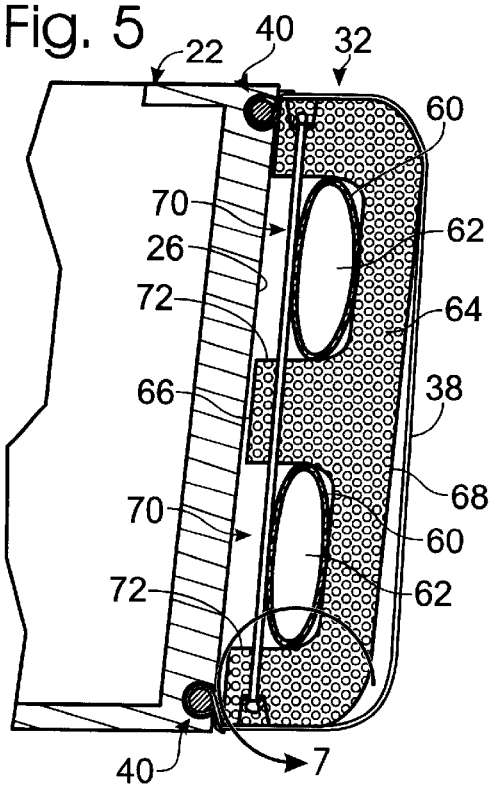
FIG. 5 is an assembled cross-sectional view of the sponson of FIG. 4, with the tubes deflated.
Figure 6:
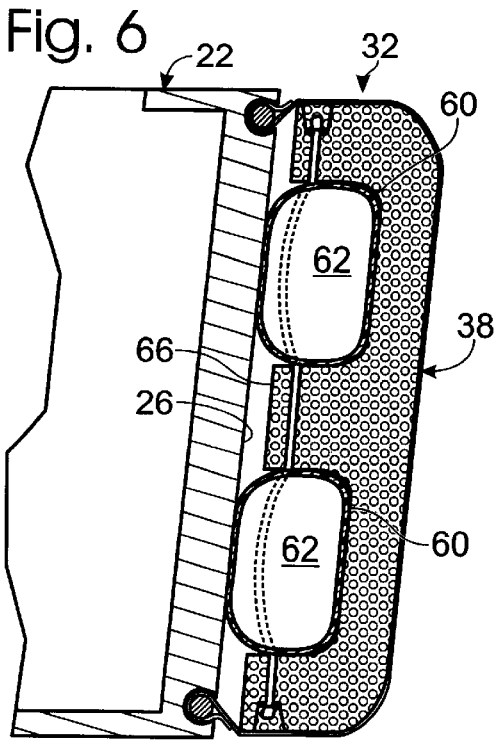
FIG. 6 is an assembled cross-sectional view of the sponson of FIG. 4, with the tubes inflated.
Figure 11:
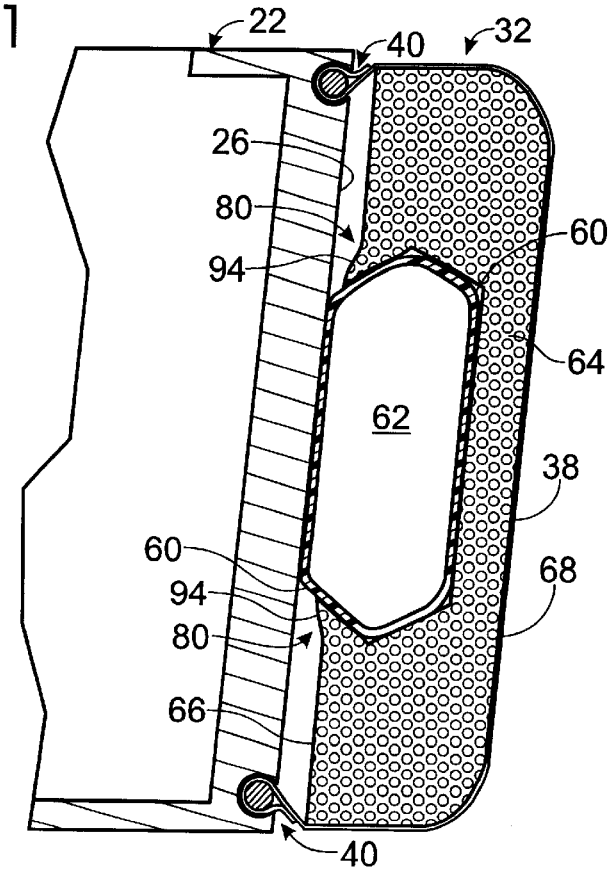
FIG. 11 is a cross-sectional view of another sponson constructed according to the present invention.

As shown in FIGS. 4–6, inflatable buoyant component 34 includes a pair of inflatable tubes or bladders 60 that define interior chambers 62 into which a volume of gas may be selectively stored to increase the buoyancy of the component. Also shown in FIG. 4 are valves 63 through which gas may be selectively added and removed from the tubes. It should be understood that the number and size of the tubes may vary. For example, component 34 may include a single tube extending along the sidewalls of the RIB's hull, such as shown in FIG. 11, or more than two such tubes. Similarly, the tubes may extend along both sidewalls and the bow region of the RIB, or two or more end-aligned tubes may be used. The tubes may be formed of any suitable length.

In FIGS. 5 and 6, it can be seen that the tubes are formed of an expandable material and the volume of the tubes increases as the tubes are inflated from the deflated configuration shown in FIG. 5 to the inflated configuration shown in FIG. 6. Tubes 60 may be formed from any suitable material adapted to selectively store a volume of gas, such as air, in an interior reservoir. Examples of suitable materials include polyurethane, PVC, hypalon, and neoprene.

By "non-inflatable buoyant component," it is meant that the component is buoyant and is not adapted to repeatedly receive a volume of gas to increase or reduce the buoyancy of the component. The term "non-inflatable buoyant component" is meant to include inherently buoyant materials. It is also meant to include buoyant foams and foamed materials that may have trapped gasses, but cannot be selectively inflated or deflated to adjust the buoyancy of the material. An example of a suitable non-inflatable buoyant material is closed-cell polyethylene, although any suitable non-inflatable buoyant material may be used. A particularly well-suited material is closed cell polyethylene having a density of 2.2 pounds per cubic foot, which is sold by Dow under the trade name Dow 220 ETHAFOAM™. Preferably, component 36 is formed from a material that has been approved for flotation.

In the illustrative embodiment shown in FIGS. 4–6, non-inflatable buoyant component 36 is formed of a foamed material 64 and has an interior surface 66 that generally conforms to the shape of the sidewall of hull 22 and a generally arcuate exterior surface 68 facing away from the hull. In the illustrated embodiment, the non-inflatable component is substantially larger than the inflatable component and generally defines the shape of the composite sponson. It should be understood, however, that the shape, thickness and material or combination of materials forming non-inflatable component 36 may vary.

Though generally heavier than the inflatable component, the non-inflatable component offers the advantage that it has an inherent buoyancy that is not lost if the component is pierced or otherwise punctured. Tubes 60, on the other hand, are lighter than the non-inflatable component, thereby decreasing the overall weight of the RIB compared to a RIB with sponsons formed completely of non-inflatable components. Furthermore, because the tubes may be deflated, they are more compact, such as for storage or transportation. Both components provide a pneumatic cushion or shock absorber to the RIB, compared to boats with rigid exterior hulls.

Non-inflatable buoyant component 36 includes mounts 70 adapted to receive the inflatable-component, such as tubes 60. In the illustrative embodiment shown in FIGS. 4–6, mounts 70 take the form of recesses, or pockets, 72 extending into foamed material 64 and into which at least a portion of tubes 60 are received. In the deflated configuration shown in FIG. 5, it can be seen that tubes 60 are completely received within pockets 72. It should be understood that this means that the inflatable component does not project beyond the opening of the pocket, which is defined by the surface of the non-inflatable component in which the pocket extends. For example, in FIG. 5, the pocket extends into the non-inflatable component from interior surface 66 of the non-inflatable component, and the pocket includes an opening coextensive with the interior surface. It should be understood that one or both ends of tubes 60 may extend beyond the ends of the non-inflatable component, such as shown in FIG. 2.

When the tubes are substantially or completely inflated, such as shown in FIG. 6, at least a portion of the tubes extend out of the pocket's opening. In this configuration, the tubes extend out of the pocket toward hull 22 and bias component 36 away from the hull. As shown, the tubes are compressed between the hull and interior surface 66 of the non-inflatable component, and components 34 and 36 are firmly engaged between hull 22 and sheath 38. As such, components 34 and 36 are securely positioned relative to the hull. The buoyant components of the sponson can be easily removed however, simply by deflating the tubes to decrease the cross-sectional dimension of the components and thereby release the tension in the sheath so that the components may be removed from the sheath as a unit without requiring the removal of sheath 38 from the RIB.

It is within the scope of the invention that the mounts on non-inflatable component 36 may extend from component 36, either in addition to or as an alternative to the inwardly extending pockets shown in FIGS. 4–6. Similarly, the inflatable components may extend in a direction relative to hull 22 other than that shown in FIGS. 4–6. As a further alternative, the tubes may extend between a pair of non-inflatable buoyant components. A benefit of having the non-inflatable component external the inflatable component is that the non-inflatable component provides a shell or protective cover to the inflatable component. For example, the non-inflatable component may be pierced by objects striking sponson 32 without having more than a negligible, if any, effect on the buoyancy of the sponson. Therefore, so long as the piercing object does not reach and penetrate the inflatable component, the sponson retains its original buoyancy.

Regardless of the configuration, it is preferred that buoyant components of the sponson have a cross-sectional dimension when the inflatable buoyant component is substantially or fully inflated and a smaller cross-sectional dimension when the inflatable buoyant component is substantially or totally deflated. The former configuration may also be referred to as an expanded configuration, with the latter configuration being referred to as a deflated configuration. Preferably, components 34 and 36 can be removed as a unit from between sheath 38 and hull 22 when in the deflated configuration, but not when in the expanded configuration.

Also shown in FIGS. 4–6 is a restraining structure 80 that removably couples inflatable buoyant component 34 to non-inflatable buoyant component 36. More particularly, and with reference to the embodiments of components 34 and 36 shown in FIGS. 4–6, the restraining structure couples tubes 60 to foamed material 64. Once coupled together, the components may be installed or removed as a unit. Preferably, the components are removably coupled together so that when desired they may be separated, such as for individual replacement or repair.

In FIGS. 4–6, restraining structure 80 takes the form of one or more bands or straps 82 that define a closed boundary around at least a portion of the inflatable component. This closed boundary may be defined by the cords or tubings alone, or in combination with the non-inflatable component. Examples of suitable straps 82 include "bungee" cords, elastomeric straps, resilient bands and the like. Straps 82 are preferably formed of a material, or otherwise coated or sheathed in a material that will not damage tubes 60, such as by puncturing or abrading the tubes to cause the tubes to leak. For example, in FIG. 7, strap 82 is sheathed within a length of flexible tubing 84. Typically, a plurality of straps will be used to couple the inflatable components to the non-inflatable components, with the straps being spaced-apart along the length of the components. For example, spacing the straps in the range of approximately two and approximately six feet apart has proven effective.

Figure 7:
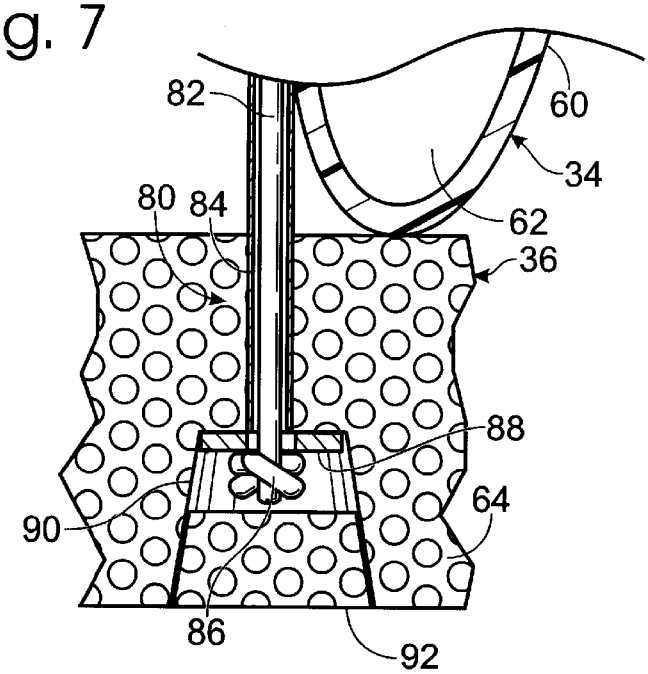
FIG. 7 is an enlarged detail showing a portion of the sponson of FIGS. 4–6.

Straps 82 may be secured to the non-inflatable buoyant component of sponson 32 via any suitable mechanism. In FIG. 7, an example of a suitable mechanism is illustrated. As shown, strap 82 extends through at least a substantial portion of component 36 and across mounts 70. The ends 86 of the straps are tied or otherwise secured to retain the strap in its mounting position. As shown, ends 86 are passed through a washer 88 or other suitable collar and then knotted so that the ends cannot be withdrawn back through the washer. In FIG. 7, the ends are received within bores 90 in the non-inflatable component, and the bores are filled with plugs 92. However, it is within the scope of the invention that the straps may be secured to the exterior of the non-inflatable component. Although a single strap 82 is shown extending across a pair of pockets 72, it should be understood that each pocket could have a separate strap.

Figure 8:
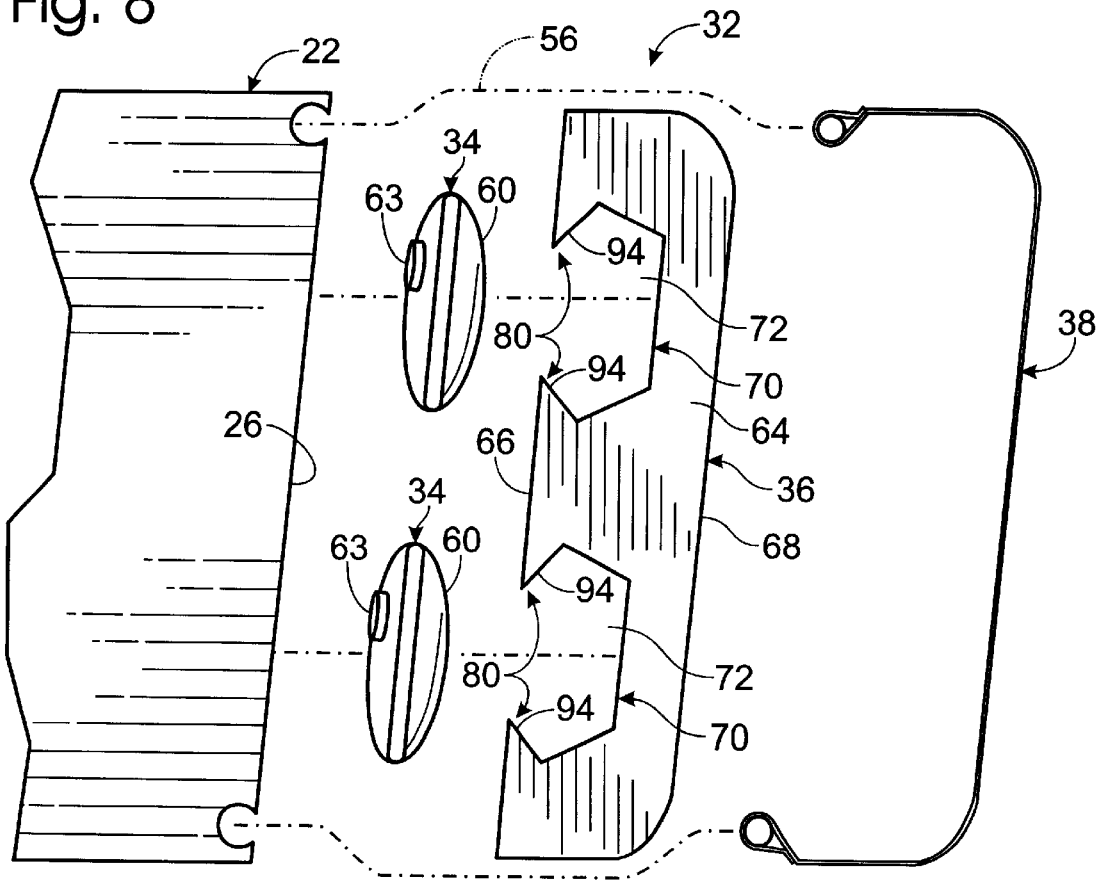
FIG. 8 is an exploded cross-sectional end view of another sponson constructed according to the present invention.
Figure 9:
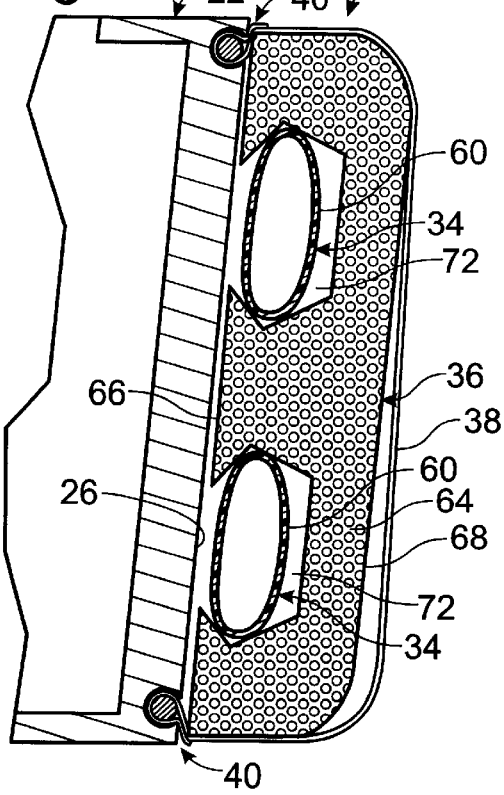
FIG. 9 is an assembled cross-sectional view of the sponson of FIG. 8, with the tubes deflated.
Figure 10:
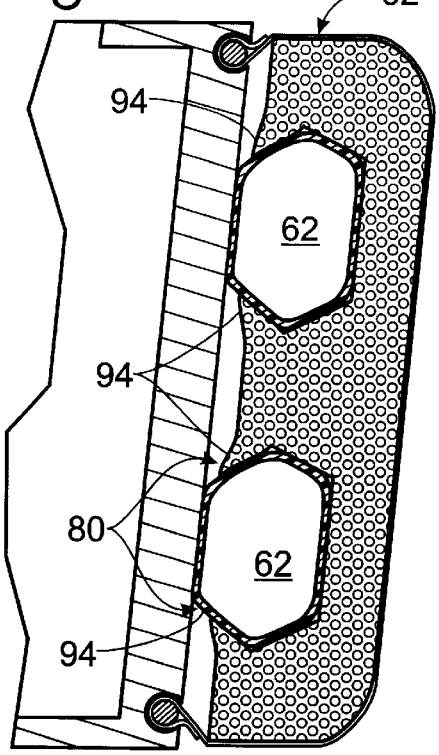
FIG. 10 is an assembled cross-sectional view of the sponson of FIG. 8, with the tubes inflated.

Another embodiment of a composite sponson constructed according to the present invention is shown in FIGS. 8–10. Unless otherwise specified, the sponson has the same elements, subelements and possible variations as the sponson shown in FIGS. 4–6. However, in FIGS. 8–10, sponson 32 includes a restraining structure 80 that does not include straps 82. Instead, structure 80 includes arms 94 that extend at least partially across the opening of pockets 72. Arms 94 are formed of a resilient material that biases the inflatable buoyant components, namely tubes 60, into pockets 72. Preferably, the arms are integrally formed with non-inflatable component 36, such as by removing, or undercutting, a portion of material 64 to form the arms.

In FIG. 9, the arms are shown in their unbiased configuration, and tubes 60 are seated within pockets 72. When the tubes are inflated, however, such as shown in FIG. 10, the tubes extend at least partially out of the pockets. When this occurs, the arms are deflected from their unbiased positions to the deflected, or biased, configuration shown in FIG. 10. In this configuration, the arms are biased to return toward their unbiased configurations and thereby urge the tubes into pockets 72. As the tubes are deflated, their cross-sectional dimension is reduced, and the arms urge the tubes back into the pockets as the arms return toward their unbiased positions.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A rigid inflatable boat, comprising:

a rigid boat hull having a sidewall with an outer surface; and at least one sponson mounted on the outer surface of the sidewall of the hull, wherein the at least one sponson comprises:

a non-inflatable buoyant component;

an inflatable buoyant component removably secured to the non-inflatable buoyant component, wherein the inflatable buoyant component is adapted to receive and selectively store a volume of gas in an internal chamber, wherein the inflatable buoyant component is selectively inflatable between a deflated configuration and an inflated configuration, and further wherein the inflatable buoyant component includes a valve through which gas may be selectively inserted into and removed from the chamber;

restraining structure removably coupling the inflatable buoyant component to the non-inflatable buoyant component; and a sheath adapted to removably secure the non-inflatable buoyant component and the inflatable buoyant component to the hull of a boat.

2. The boat of claim 1, wherein the sheath and the sidewall collectively define a closed perimeter into which the non-inflatable buoyant component and the inflatable buoyant component are received.

3. The boat of claim 2, wherein in the deflated configuration the inflatable buoyant component and the non-inflatable buoyant component are adapted to be removed as a unit from the closed perimeter.

4. The boat of claim 2, wherein in the inflated configuration the inflatable buoyant component and the non-inflatable buoyant component respectively are biased against the sidewall and the sheath to prevent removal of the non-inflatable buoyant component and the inflatable buoyant component as a unit from the closed perimeter.

5. The boat of claim 1, wherein in the inflated configuration the inflatable buoyant component has a cross-sectional dimension that is larger than the cross-sectional dimension of the inflatable buoyant component in the deflated configuration.

6. The boat of claim 1, wherein the inflatable buoyant component is adapted to bias the non-inflatable buoyant component away from the hull and against the sheath as the inflatable buoyant component is inflated.

7. The boat of claim 6, wherein the non-inflatable buoyant component is maintained in a spaced-apart configuration from the hull by the inflatable buoyant component when the inflatable buoyant component is in the inflated configuration.

8. The boat of claim 1, wherein the non-inflatable buoyant component includes a mount adapted to receive the inflatable buoyant component.

9. The boat of claim 8, wherein the restraining structure is adapted to bias the inflatable buoyant component against the mount.

10. The boat of claim 9, wherein the restraining structure includes arms that bias the inflatable buoyant component against the mount.

11. The boat of claim 1, wherein the non-inflatable buoyant component includes a pocket with an opening, and further wherein at least a portion of the inflatable buoyant component extends into the pocket.

12. The boat of claim 11, wherein the inflatable buoyant component is completely received within the pocket when the inflatable buoyant component is in the deflated configuration.

13. The boat of claim 12, wherein in the deflated configuration the inflatable buoyant component is received within the pocket and does not extend through the opening, and further wherein in the inflated configuration at least a portion of the inflatable buoyant component extends through the opening and out of the pocket.

14. The boat of claim 13, wherein in the inflated configuration, the inflatable buoyant component extends through the opening and against the hull and biases the non-inflatable buoyant component away from the hull.

15. The boat of claim 11, wherein the restraining structure is adapted to bias the inflatable buoyant component into the pocket.

16. The boat of claim 15, wherein the restraining structure includes one or more straps that extend across the pocket.

17. The boat of claim 16, wherein the straps are formed of an elastomeric material.

18. The boat of claim 16, wherein the straps include a protective cover.

19. The boat of claim 15, wherein the restraining structure includes arms that extend across at least a portion of the opening of the pocket.

20. The boat of claim 19, wherein the arms are formed of a resilient material.

21. The boat of claim 19, wherein when the inflatable buoyant component is in the inflated configuration, at least a portion of the inflatable buoyant component extends through the opening of the pocket and deflects the arms away from the pocket to a biased configuration, and further wherein the arms are biased to return toward the pocket upon deflation of the inflatable buoyant component.

22. The boat of claim 19, wherein the arms are integrally formed with the non-inflatable buoyant component.

23. A rigid inflatable boat, comprising:

a rigid boat hull having a sidewall with an outer surface; and at least one sponson mounted on the outer surface of the sidewall of the hull, wherein the at least one sponson comprises:

a non-inflatable buoyant component having a surface and a pocket that extends into the non-inflatable buoyant component from an opening on the surface;

an inflatable buoyant component removably secured to the non-inflatable buoyant component and extending at least partially into the pocket, wherein the inflatable buoyant component is adapted to receive and selectively store a volume of gas in an internal chamber, wherein the inflatable buoyant component is selectively inflatable between a deflated configuration, in which the inflatable buoyant component is received within the pocket and does not extend through the opening, and an inflated configuration, in which at least a portion of the inflatable buoyant component extends through the opening toward the sidewall of the hull;

restraining structure removably coupling the inflatable buoyant component to the non-inflatable buoyant component, wherein the restraining structure is adapted to bias the inflatable buoyant component into the pocket; and a sheath that extends around at least a portion of the non-inflatable buoyant component and couples the sponson to the hull.

24. The boat of claim 23, wherein in the inflated configuration, the inflatable buoyant component extends against the hull and urges the non-inflatable buoyant component against the sheath.

25. The boat of claim 23, wherein the restraining structure includes one or more straps that extend across the pocket.

26. The boat of claim 25, wherein the straps are formed of an elastomeric material.

27. The boat of claim 25, wherein the straps include a protective cover.

28. The boat of claim 23, wherein the restraining structure includes arms that extend across at least a portion of the opening of the pocket.

29. The boat of claim 28, wherein the arms are formed of a resilient material.

30. The boat of claim 29, wherein when the inflatable buoyant component is in the inflated configuration, at least a portion of the inflatable buoyant component extends through the opening of the pocket and deflects the arms away from the pocket to a biased configuration, and further wherein the arms are biased to return toward the pocket upon deflation of the inflatable buoyant component.

31. The boat of claim 28, wherein the arms are integrally formed with the non-inflatable buoyant component.

32. A rigid inflatable boat, comprising:

a rigid boat hull having a sidewall with an outer surface; and at least one sponson mounted on the outer surface of the sidewall of the hull, wherein the at least one sponson comprises:

a non-inflatable buoyant component having a surface and a pocket that extends into the non-inflatable buoyant component from an opening on the surface;

an inflatable buoyant component removably secured to the non-inflatable buoyant component and extending at least partially into the pocket, wherein the inflatable buoyant component is adapted to receive and selectively store a volume of gas in an internal chamber, wherein the inflatable buoyant component is selectively inflatable between a deflated configuration, in which the inflatable buoyant component is received within the pocket and does not extend through the opening, and an inflated configuration, in which at least a portion of the inflatable buoyant component extends through the opening toward the sidewall of the hull; and means for removably coupling the inflatable buoyant component to the non-inflatable buoyant component.

* * * * *